United States Patent [19]

Kohama et al.

[11] Patent Number: 4,657,507

[45] Date of Patent: Apr. 14, 1987

[54] HEATING CONTROL METHOD OF HEAT FURNACE

[75] Inventors: Satoshi Kohama, Osaka; Yoshinori Wakamiya; Makoto Tsuruda, both of Hyogo, all of Japan

[73] Assignees: Kobe Steel, Ltd., Hyogo; Mitsubishi Denki Kabushiki Kaisha, Tokyo, both of Japan

[21] Appl. No.: 833,023

[22] Filed: Feb. 26, 1986

[30] Foreign Application Priority Data

Feb. 27, 1985 [JP] Japan ..... 60-40375
Feb. 27, 1985 [JP] Japan ..... 60-40379

[51] Int. Cl.[4] ..... F27B 9/12

[52] U.S. Cl. ..... 432/18; 236/15 BB; 266/80; 266/87; 266/90; 432/37

[58] Field of Search ..... 110/185–187, 110/191; 431/12, 75, 78; 236/15 BB, 15 BD; 432/18, 36, 37, 45; 364/150, 151, 153, 477; 266/80, 81, 87–90; 148/128

[56] References Cited

U.S. PATENT DOCUMENTS 4,255,133 3/1981 Tanifuji et al. ..... 432/36 X
4,394,121 7/1983 Wakamiya et al. ..... 432/18 X
4,501,552 2/1985 Wakamiya ..... 236/15 BB X
4,606,529 8/1986 Tooch ..... 266/80

FOREIGN PATENT DOCUMENTS 48011 3/1983 Japan .
100626 6/1985 Japan ..... 148/128
2146464 4/1985 United Kingdom ..... 266/87

*Primary Examiner*—Albert J. Makay
*Assistant Examiner*—Steven E. Warner
*Attorney, Agent, or Firm*—Bernard, Rothwell & Brown

[57] ABSTRACT

In heating control method of a heat furnace, three non-linear models, model to calculate furnace temperature based on the fuel flow rate by unsteady heat balance system, model to estimate furnace wall temperature distribution based on the furnace temperature and model to estimate material temperature based on the furnace temperature, are used, linearization is performed by perturbation simulation to vary the flow rate stepwise and the optimization to minimize the fuel flow rate is performed and the optimum furnace temperature per each material is determined, and the mixed combustion ratio of plural fuels obtained by dividing total calorific value of each fuel by total calorific value of all fuels and the furnace temperature setting value are calculated using the optimum furnace temperature per material and then set.

2 Claims, 6 Drawing Figures

HEATING CONTROL METHOD OF HEAT FURNACE

BACKGROUND OF THE INVENTION

1. Field of the Invention

The present invention relates to temperature control of a heat furnace in hot rolling line, wherein furnace temperature setting value to minimize fuel amount and mixed combustion ratio of plural fuels are set.

2. Description of the Prior Art

Temperature control of such heat furnace in the prior art is disclosed, for example, in Japanese examined patent publication No. 48011/1983, wherein both non-linear models, model to calculate material temperature from furnace temperature and model to calculate fuel flow rate from the furnace temperature and the material temperature, are used, the furnace temperature is varied in steps and linearization is performed using perturbation simulation method (method of performing simulation at the reference state and the perturbation state and determining the linearization coefficient) in order to minimize the non-linear fuel amount, temperature rise curve of the material is determined using results of the linearization, and the temperature rise curve and the existing temperature of the material are compared so as to determine the furnace temperature.

In above-mentioned heating control method of a heat furnace in the prior art, since the calculation zones of furnace temperature are usually larger in number than the zones to control the fuel flow rate as shown in FIG. 1, the optimum furnace temperature and the temperature rise curve after optimization by the perturbation method based on the furnace temperature are not always the realizable pattern.

When the linearization coefficient and the temperature rise pattern are determined, since the amount of heat loss to a furnace wall, temperature distribution in the furnace wall and the like are ignored and the simulation is performed by varying the furnace temperature stepwise without taking into consideration response delay of the furnace, the temperature rise curve being different from the actual temperature rise tendency of the material and state of the furnace may be determined.

Also in the method of the prior art, as shown in FIG. 2, a furnace temperature detector 104 to obtain feedback signal is installed at one position per each control region 101*a*. Consequently, it can control the furnace temperature of one position.

In a heat furnace in general, since the material temperature becomes higher in a position closer to the extraction end, a burner is designed so that the temperature at the burner side becomes high as shown in FIG. 2. When the low load material exists at the front side and the high load material exists at the rear side within the control region as shown in FIG. 2, the furnace temperature is controlled corresponding to the temperature within the furnace desired for the high load material. Consequently, the furnace temperature is set inevitably to higher value, resulting in large loss from the viewpoint of fuel consumption.

SUMMARY OF THE INVENTION

In order to eliminate above-mentioned disadvantages in the prior art, an object of the invention is to provide heating control method of a heat furnace wherein loss in the fuel consomption is reduced and temperature distribution in the control region is properly controlled.

In the invention, three non-linear models, namely model to calculate furnace temperature based on the fuel flow rate by unsteady heat balance system, model to estimate furnace wall temperature based on the furnace temperature and model to estimate material temperature based on the furnace temperature, are used to determine the optimum furnace temperature per material, and mixed combustion ratio of plural fuels and the furnace temperature setting value are calculated and set using the optimum furnace temperature per material. Consequently, even when the high load material and the low load material are mixed in the furnace, the furnace temperature setting value to satisfy the desired furnace temperature per material and to minimize the fuel flow rate can be obtained and the extraction temperature can be controlled accurately.

Other objects and disadvantages of the invention will be apparent from the following detailed description of embodiments taken in connection with the accompanying drawings.

PREFERRED EMBODIMENTS OF THE INVENTION

Principle of the invention will be described.

Figure 3:
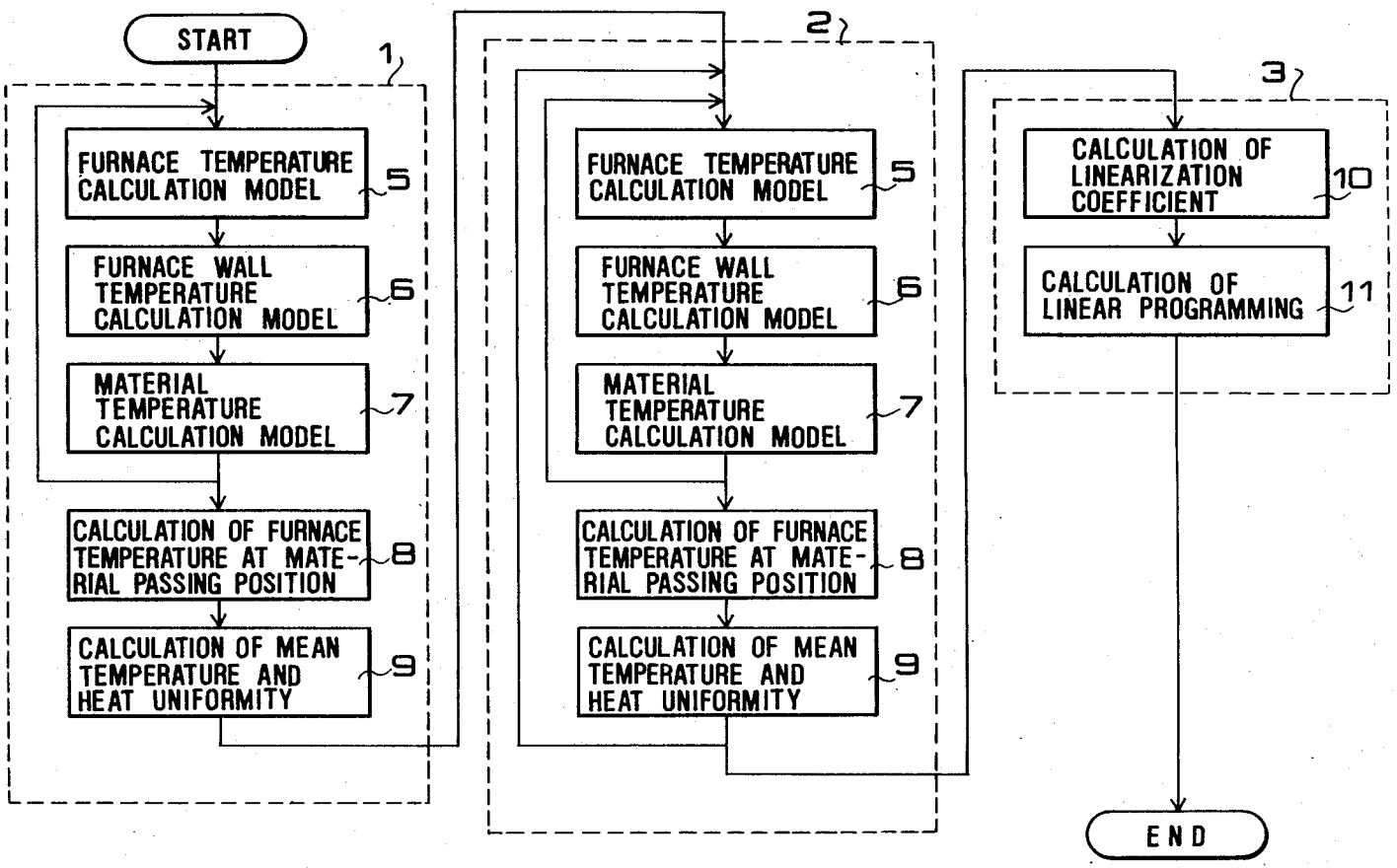
FIG. 3 is a flow chart illustrating method of determining the optimum furnace temperature per material.

FIG. 3 is a flow chart illustrating method of determining the optimum furnace temperature per material. In FIG. 3, numeral 1 designates the first step to calculate the the optimum furnace temperature, numeral 2 the second step, and numeral 3 the third step. Numeral 5 designates a furnace temperature calculation model, numeral 6 a furnace wall temperature calculation mode, numeral 7 a material temperature calculation model, numeral 8 calculation of the furnace temperature at material passing position, numeral 9 calculation of mean temperature and heat uniformity, numeral 10 calculation of linearization coefficient, and numeral 11 calculation of linear programming (LP).

Models 5, 6, 7 in the flow chart will be described.

Figure 1:
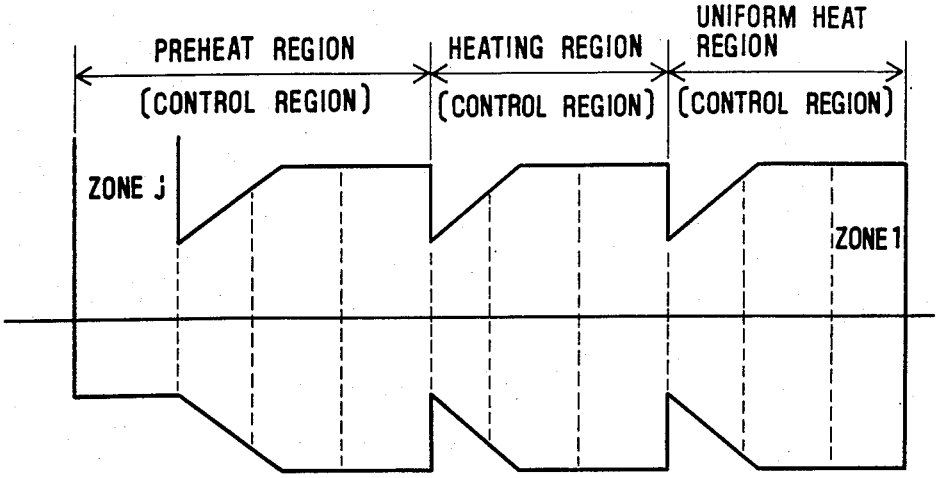
FIG. 1 is a schematic diagram of a heat furnace illustrating dividing of furnace temperature calculation zones.
Figure 2:
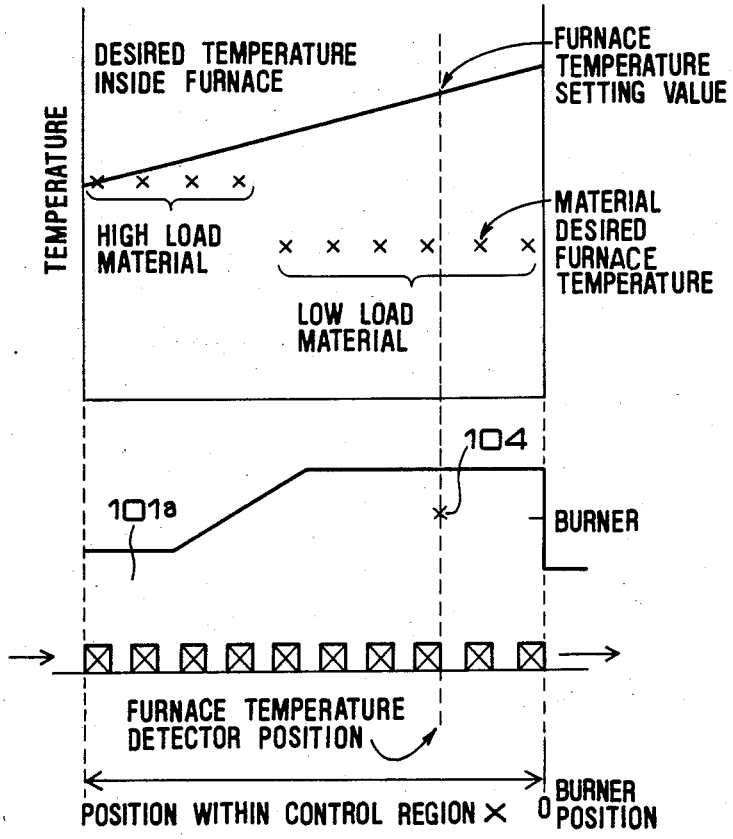
FIG. 2 (PRIOR ART)
FIG. 2 is a diagram illustrating heating control method of a heat furnace in the prior art.

The furnace temperature calculation model 5 is constituted as follows. The heat furnace is divided in the longitudinal direction into n meshes as shown in FIG. 1, the following heat balance equation is set to each divided mesh.

$$Cl \cdot \frac{dTgi}{dt} \ldots \text{variation of furnace temperature}$$

-continued $= Qi$ . . . sensible heat of fuel and air $+ Hg \cdot Wi$ . . . fuel calorific value $+ Gi + 1 \cdot Cpg \cdot Tgi + 1$ . . . exhaust gas heat amount from upstream $- Gi \cdot Cpg \cdot Tgi$ . . . exhaust gas heat amount to downstream $$+ \sum_{j=1}^{n} klij\{(Tgj + 273)^4 - (Tgi + 273)^4\}$$

. . . radiation from furance temperature at other mesh $$+ \sum_{k=1}^{n} K2jk\ \{(Twk + 273)^4 - (Tgi + 273)^4\}$$

. . . radiation from furnace wall $$+ \sum_{k=1}^{m} K3i^{l}\ \{(Tsl + 273)^4 - (Tgi + 273)^4\}$$

. . . radiation to material $+ C2\ (Twi - Tgi) + C3\ (Tsi - Tgi)$

. . . convection to furnace wall and material $-Qwi$ . . . skid cooling water loss Wherein, Hg: fuel calorific value per unit flow rate, Cpg: specific heat of exhaust gas, Gi: exhaust gas flow rate of each mesh, K1ij, K2jk, K3il: radiation changing coefficient, C1, C2, C3: constant, n: furnace length dividing number, m: slab number.

If the fuel flow rate is given and the furnace wall temperature and the slab temperature are already known, equation (1) is converted as follows:

$$\frac{dTgi}{dt} = \sum_{j=1}^{n} Aij\ (Tgj + 273)^4 + \sum_{k}^{n} Bik \cdot Tgk + Ci\ (i = 1 \ldots n) \quad (2)$$

This is simultaneous non-linear differential equations with n unknowns. If the temperature distribution within the furnace before one step is taken as the starting value and made discrete with respect to time and then converged using Newton's method, the new temperature distribution within the furnace can be calculated simply.

The material temperature model 7 is expressed from known heat conduction equation of second degree as follows:

$$\frac{dTsl}{dt} = \frac{\lambda s}{Cs \cdot \gamma s}\left(\frac{d^2Tsl}{dx^2} + \frac{d^2Tsl}{dy^2}\right) \quad (3)$$

Boundary conditions on the surface become $$\frac{dT_{sl}}{dx} = \frac{C_{x0}}{\lambda_s} \cdot qs \quad (4)$$

$x = 0$ $$\frac{dT_s}{dx} = \frac{CXd}{\lambda_s} \cdot qs$$

$x = d_1$ $$\frac{dT_s}{dy} = \frac{Cyd}{\lambda_s} \cdot qs$$

$y = 0$

-continued $$\frac{dT_s}{dy} = \frac{C_{y0}}{\lambda_s} \cdot qs$$

$y = d_2$

Wherein, x: material thickness direction, y: material width direction. d1, d2 represent thickness and width of material respectively. Cs, λs, γs represent specific heat, thermal conductivity and specific gravity of material respectively. qs is surface heat flow flux of material and expressed as follows:

$$qs = \sum_{i=1}^{n} k31\ l\{(Tqi + 273)^4 - (Tsl + 273)^4\} + C3\ (Tsl - Tgl) \quad (5)$$

Equation (3) can be solved by usual difference calculus using boundary conditions of equation (4).

The furnace wall temperature model 6 in each mesh of the furnace longitudinal dividing as shown in FIG. 1 is expressed by one-dimensional heat conduction equation only in the thickness direction as follows:

$$\frac{dT_w}{dt} = \frac{\lambda_w}{C_w \cdot \gamma_w} \cdot \frac{d^2T_w}{dx^2} \quad (6)$$

Boundary condition on surface within the furnace is $$\left.\frac{dT_w}{dx}\right|_{x=0} = \frac{1}{\lambda_w} \cdot \sum_{j=1}^{n} k2ij\ \{(Tgi + 273)^4 - (Tw + 273)^4\} + C2\ (Tgi - Tw) \quad (7)$$

Boundary condition on surface outside the furnace is $$\left.\frac{dT_w}{dx}\right|_{x=0} = \frac{1}{\gamma_w} \cdot H_{OUT} \cdot (Tw - Tair) \quad (8)$$

Wherein, x: furnace wall thickness direction, d3: thickness of furnace wall. Cw, λw, γw represent specific heat, thermal conductivity and specific gravity of furnace wall respectively. $H_{OUT}$: outer thermal conductivity, Tair: outer temperature. Equation (6) can be also solved by usual difference calculus using boundary conditions of equations (7) (8).

If the fuel flow rate is given by combining the three models 5, 6, 7, the existing values of the furnace temperature, material temperature, furnace wall temperature are used as initial values and three future values of the furnace temperature, material temperature and furnace wall temperature can be calculated.

Method of determining the optimum furnace temperature per material will be described referring to FIG. 3.

In step 1, the three modes 5, 6, 7 are repeatedly used while all materials are extracted in the existing flow rate Wk°, thereby the mean temperature $\overline{T}s°$ during extraction of each material, the heat uniformity (maximum temperature—minimum temperature) ΔTs° and the temperature inside furnace Tgi° at each position during the material passing can be calculated.

In step 2, the fuel flow rate is varied stepwise by ΔWk* per each fuel flow rate control region, thereby the mean temperature $\overline{T}sk$ during extraction of each material while each flow rate is varied, the heat uniformity ΔTsk and the temperature inside furance Tgik during the material passing can be calculated in similar manner to step 1.

In step 3, the calculation 10 of linearization coefficient is executed as hereinafter described. By processing in step 2, the mean temperature of each material during the extraction, the heat uniformity and the temperature inside furnace at each calculation zone during passing of each material as solutions of the non-linear equations can be linearized as follows:

$$\overline{Ts} = \overline{Ts}^{\circ} + \sum_{k=1}^{KMAX} P1k \cdot \Delta Wk \tag{9}$$

$$\Delta Ts^{\circ} = Ts + \sum_{k=1}^{KMAX} P2k \cdot \Delta Wk \tag{10}$$

$$Tgi = Tgi^{\circ} + \sum_{k=1}^{KMAX} P3iK \cdot \Delta Wk \tag{11}$$

Wherein, KMAX: number of fuel flow rate control region, P1k, P2k, P3ik are linearization coefficients at variation of each flow rate, and expressed as follows:

$$P1k = \frac{(\overline{T}_s^k - \overline{T}_s^{\circ})}{\Delta W_k^*} \tag{12}$$

$$P2k = \frac{(\Delta T_s^k - \Delta T_s^{\circ})}{\Delta W_k^*} \tag{13}$$

$$P3ik = \frac{(T_{gi}^k - T_{gi}^{\circ})}{W_k^*} \tag{14}$$

Assuming that ΔWk by variation amount of each control region, each fuel flow rate is expressed as follows:

$$Wk = Wk^{\circ} + \Delta Wk$$

From metallurgical restriction of materials and restriction in furnace operation, restricting conditions in performing the fuel optimization are as follows:

$$\overline{T}s\ MIN \leqq \overline{T}s \leqq \overline{T}S\ MAX$$

$$\Delta Ts\ MIN \leqq \Delta Ts \leqq \Delta Ts\ MAX$$

$$TgiMIN \leqq Tgi \leqq Tgi\ MAX$$

$$Wk\ MIN \leqq Wk \leqq Wk\ MAX \tag{15}$$

Wherein, suffixes MIN, MAX represent lower limit value and upper limit value respectively.

Criterion of the optimization is minimizing of fuel and therefore expressed as follows:

$$\phi = \sum_{k=1}^{KMAX} Wk \tag{16}$$

Minimizing of equation (16) under restricting conditions of equation (15) can be estimated by the calculation 11 of linear programming (LP).

The flow rate in the above solution is the optimum flow rate Wkopt of each material, and at the same time the optimum furnace temperature Tgi* of each material is calculated by equation (11).

Method of calculating the setting furnace temperature and the mixed combustion ratio in each control region using the optimum furnace temperature per each material will be described.

Since the optimum furnace temperature of each material at every position within the furnace has been calculated, the optimum furnace temperature of the calculation zone corresponding to the position of each material after any time from the existing time is made the furnace temperature desired for each material. However, material which exists at the extraction side and is extracted after any time has the temperature of the calculation zone at the most extracting side at desired furnace temperature. Then, position of each material is made Xj and the desired furnace temperature is made Tji*. j designates the material No.

Assume that two sorts of fuels, fuel A to realize temperature distribution within the furnace to raise the temperature at usual burner side (e.g., heavy oil) and fuel B of slow burning type to suppress combustion at the burner side to the possible limit (e.g., converter gas), are used as fuels in each control region, and the combustion temperature characteristics of both fuels are different.

The mixed combustion ratio is defined as follows:

$$\text{mixed combustion ratio} = \frac{\text{total calorific value of fuel } A}{\text{(total calorific value) of fuel A} + \text{(total calorific value) of fuel B}} \tag{17}$$

Figure 4:
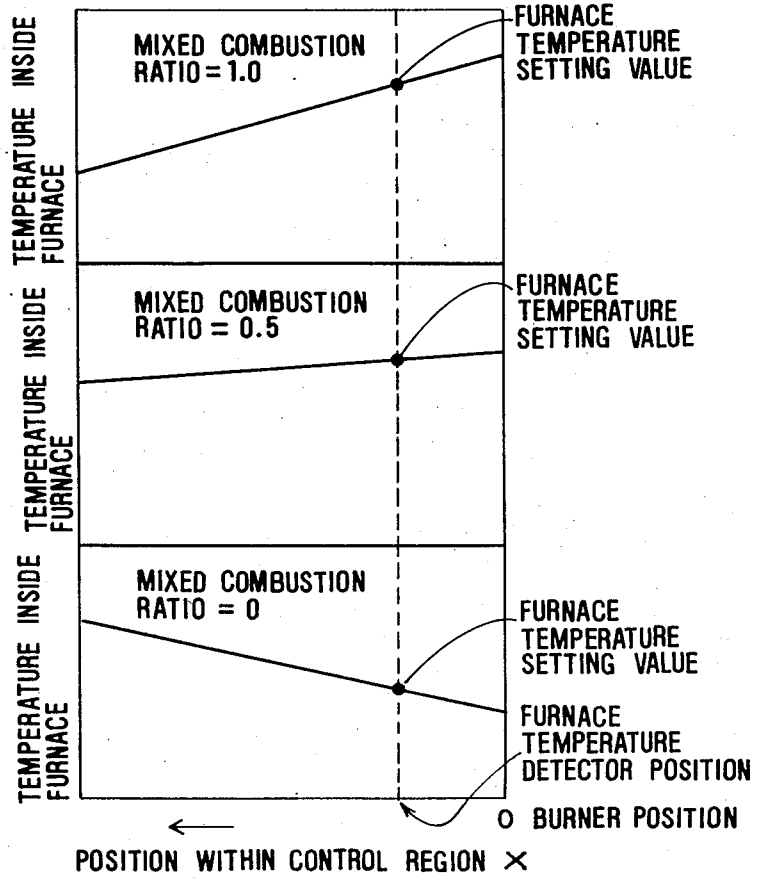
FIG. 4 is a correlation diagram between mixed combustion ratio and temperature within a furnace.

If the mixed combustion ratio is varied, the temperature distribution within the furnace at each control region can be changed in equal total calorific value as shown in FIG. 4.

The mixed combustion ratio and the setting furnace temperature are determined by position xj of each material and desired furnace temperature as follows:

$$\text{mixed combustion ratio} = k1 \cdot \frac{N \cdot \Sigma Tji^* \cdot xj - \Sigma xj \cdot \Sigma Tgj^*}{N \cdot \Sigma xj^2 - (\Sigma xj)^2} \tag{18}$$

$$\text{setting furnace temperature} = K2 \cdot \frac{N \cdot \Sigma Tji^* \cdot xj - \Sigma xj \cdot \Sigma Tgj^*}{N \cdot \Sigma xj^2 - (\Sigma xj)^2} \cdot XT + k3 \cdot \frac{\Sigma Tgj^* \cdot \Sigma xj^2 - \Sigma Tgj^* \cdot xj \cdot \Sigma xj}{N \Sigma xj^2 - (\Sigma xj)^2} \tag{19}$$

Wherein, k1, k2, k3: constant

N: number of material within control region

XT: position of furnace temperature detector

Figure 5:
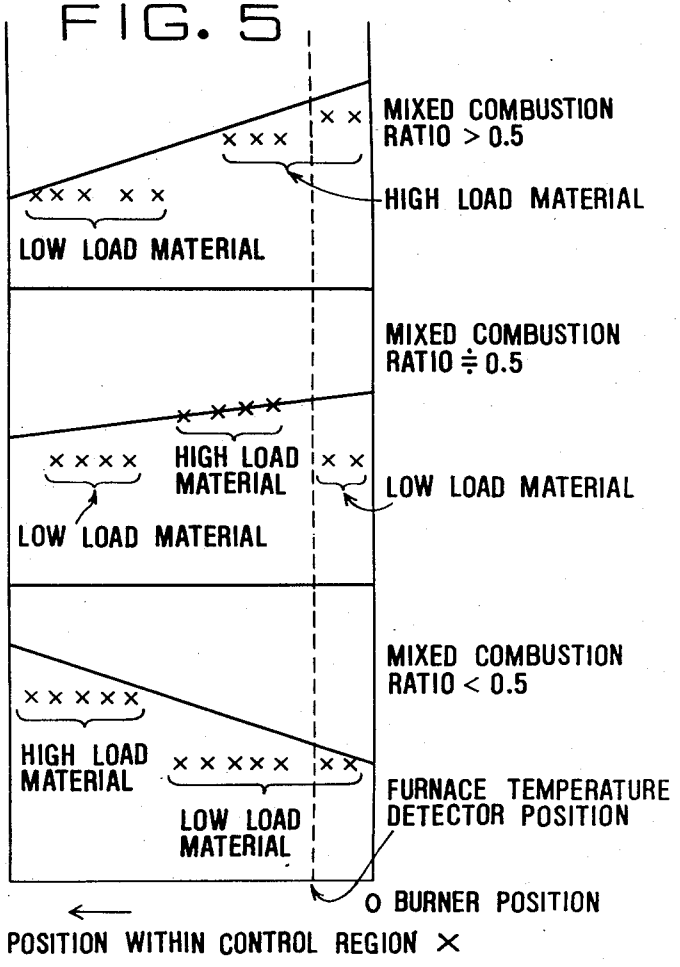
FIG. 5 is a diagram illustrating effect of the invention.

As shown in FIG. 5, even when the high load material and the low load material are mixed within the furnace, the extraction temperature can be controlled accurately and furthermore the loss in the fuels A, B can be reduced to the minimum value.

The heat furnace control based on an embodiment of the invention will be described referring to FIG. 6.

Figure 6:
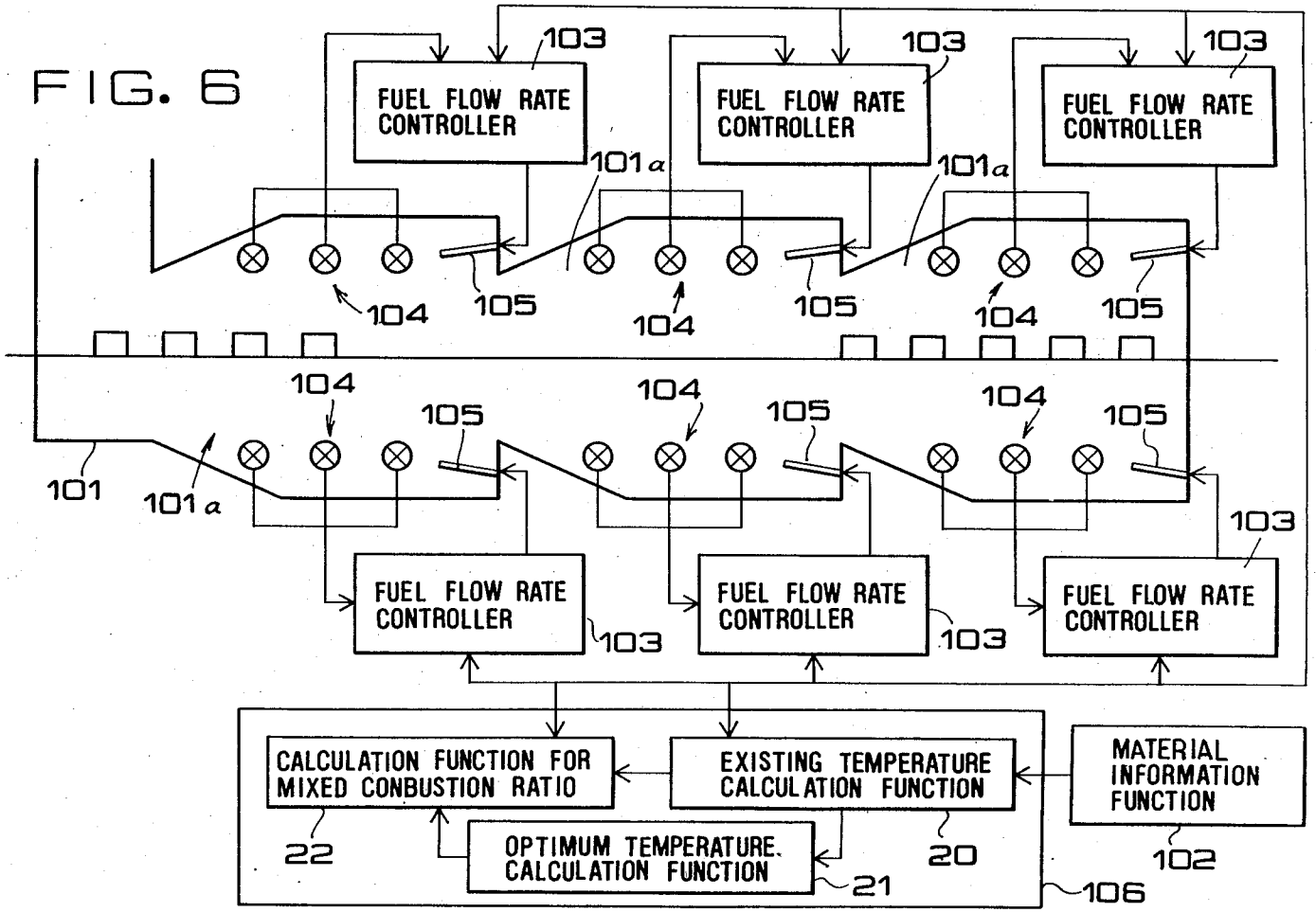
FIG. 6 is a whole constitution diagram of an embodiment of the invention.

In FIG. 6, a heat furnace 101 is divided into a plurality of control regions 101*a*, and combustion burners 105 and fuel temperature detectors 104 are arranged in the heat furnace 101. The flow rate is controlled by a fuel flow rate controller 103 in each region so that the furnace temperature in each region becomes the setting value set by a furnace temperature setting function 106. Numeral 102 designates a material information function which indicates the material information regarding dimension of material in the furnace, its weight, extraction temperature, conveying information within the furnace or the like to the furnace temperature setting function 106.

The furnace temperature setting function 106 comprises an existing temperature calculation function 20, an optimum temperature calculation function 21 per material, and a calculation function 22 for the mixed combustion ratio and the setting furnace temperature, and is started periodically. The existing temperature calculation function 20 calculates the existing material temperature by the furnace temperature calculation model 5, the furnace wall temperature calculation model 6 and the material temperature calculation model 7 based on the material information. The optimum furnace temperature calculation function 21 per material determines the optimum furnace temperature per each material under the fuel minimizing according to the flow chart in FIG. 3 as described in the explanation of the invention.

The calculation function 22 for the mixed combustion ratio and the setting furnace temperature calculates the furnace temperature of each control region according to equations (18) (19) using the desired furnace temperature and the position of each material, and indicates the calculated value to the fuel flow rate controller 103.

In the invention as above described, future variation of the temperature inside the furnace, the furnace wall temperature, the material temperature is taken into consideration based on the fuel flow rate, the desired furnace temperature for each material which minimizes the fuel flow rate and can be realized is determined, and the furnace temperature setting value and the mixed combustion ratio of each control region are set based on the desired furnace temperature. Consequently, even when the high load material and the low load material are mixed in the furnace, the extraction temperature can be controlled accurately and moreover the fuel flow rate can be reduced significantly.

What is claimed is:

1. Heating control method of a heat furnace, wherein a continuous heat furnace has a plurality of heating control regions, said heating control method comprising:

(a) first step of calculating time variation of furnace temperature based on fuel flow rate by unsteady heat balance system;

(b) second step of calculating time variation of inner temperature of a furnace wall from the furnace temperature;

(c) third step of calculating time variation of inner temperature of material from the furnace temperature;

(d) fourth step of calculating mean temperature of each control region at material extraction state in the existing flow rate, heat uniformity thereof, and each furnace temperature at material passing state, using the calculation values obtained from said first, second and third steps;

(e) fifth step of calculating mean temperature of each control region at material extraction state when the fuel flow rate is varied from the existing flow rate by a definite value, heat uniformity thereof, and each furnace temperature of material passing state, using the calculation value obtained from said first, second and third steps; and (f) sixth step of calculating linearization coefficient in the existing flow rate based on the calculation values obtained from said fourth and fifth steps, and determining the optimum furnace temperature per material to minimize the fuel under restricting conditions using the linearization coefficient to control the heating regions of said heat furnace.

2. Heating control method of a heat furnace as set forth in claim 1, further comprising seventh step of calculating and setting the mixed combustion ratio of plural fuels obtained by dividing the total calorific value of all fuels and the fuel temperature setting value, using the optimum furnace temperature per material obtained from said sixth step.

* * * * *

UNITED STATES PATENT AND TRADEMARK OFFICE

CERTIFICATE OF CORRECTION

PATENT NO. : 4,657,507

DATED : April 14, 1987

INVENTOR(S) : Satoshi Kohama et al.

It is certified that error appears in the above-identified patent and that said Letters Patent is hereby corrected as shown below:

Column 3, line 27, at the right-hand margin, insert -- (1) -- to identify equation (1).

Column 4, line 42, in equation (8), "x=0" should be -- $x=d_3$ --.

Column 5, line 2, "furance" should be -- furnace --.

Signed and Sealed this

Twenty-fifth Day of August, 1987

*Attest:*

DONALD J. QUIGG

*Attesting Officer*

*Commissioner of Patents and Trademarks*